US009016483B2

(12) United States Patent
Howley

(10) Patent No.: US 9,016,483 B2
(45) Date of Patent: Apr. 28, 2015

(54) DUAL PLANE SELF-ADJUSTING SHELF

(75) Inventor: Michael Robert Howley, McKinney, TX (US)

(73) Assignee: Frito-Lay North America, Inc., Plano, TX (US)

( * ) Notice: Subject to any disclaimer, the term of this patent is extended or adjusted under 35 U.S.C. 154(b) by 258 days.

(21) Appl. No.: 12/945,143

(22) Filed: Nov. 12, 2010

(65) Prior Publication Data

US 2012/0118840 A1 May 17, 2012

(51) Int. Cl.

| | |
|---|---|
| ***A47F 5/08*** | (2006.01) |
| ***A47F 1/12*** | (2006.01) |
| ***B65G 1/02*** | (2006.01) |
| *A47F 1/04* | (2006.01) |

(52) U.S. Cl.

CPC . *A47F 1/126* (2013.01); *A47F 1/04* (2013.01); *B65G 1/023* (2013.01); *B65G 1/026* (2013.01)

(58) Field of Classification Search

USPC ..... 211/59.2, 59.3, 126.1, 151, 126.15; 193/35 R, 35 F, 35 J; 221/226, 279; 312/71, 61; 108/60, 61

See application file for complete search history.

(56) References Cited

U.S. PATENT DOCUMENTS

| | | | | | |
|---|---|---|---|---|---|
| 2,769,551 | A | * | 11/1956 | Just | 211/59.2 |
| 2,954,128 | A | * | 9/1960 | Gordon | 211/59.3 |
| 3,008,583 | A | | 11/1961 | Lindell | |
| 3,161,295 | A | * | 12/1964 | Chesley | 211/59.3 |
| 3,468,455 | A | | 9/1969 | Voorhis | |
| 4,205,763 | A | * | 6/1980 | Merl | 221/173 |
| 4,423,818 | A | * | 1/1984 | Spamer | 211/59.2 |
| 4,730,741 | A | | 3/1988 | Jackle | |
| 4,762,236 | A | | 8/1988 | Jackle | |
| 4,901,869 | A | * | 2/1990 | Hawkinson et al. | 211/59.3 |
| 4,923,070 | A | * | 5/1990 | Jackle et al. | 211/59.2 |
| 5,190,186 | A | | 3/1993 | Yablans | |
| 5,240,125 | A | | 8/1993 | Kunz | |
| 5,788,090 | A | * | 8/1998 | Kajiwara | 211/59.2 |
| 6,089,385 | A | * | 7/2000 | Nozawa | 211/59.2 |
| 6,142,317 | A | * | 11/2000 | Merl | 211/59.3 |
| 6,273,276 | B1 | * | 8/2001 | Upton et al. | 211/59.2 |
| 6,523,702 | B1 | * | 2/2003 | Primiano et al. | 211/59.2 |
| 6,820,754 | B2 | | 11/2004 | Ondrasik | |
| 6,886,700 | B2 | * | 5/2005 | Nagel | 211/59.3 |
| 7,007,790 | B2 | * | 3/2006 | Brannon | 198/346 |
| D544,250 | S | * | 6/2007 | Daugherty et al. | D6/463 |
| 7,497,342 | B2 | * | 3/2009 | Hardy | 211/59.3 |
| 7,628,282 | B2 | * | 12/2009 | Hardy | 211/59.3 |
| D613,101 | S | * | 4/2010 | Hardy | D6/515 |
| 7,913,861 | B2 | * | 3/2011 | Mueller et al. | 211/59.3 |
| 8,025,162 | B2 | * | 9/2011 | Hardy | 211/59.3 |
| 8,038,017 | B2 | * | 10/2011 | Close | 211/59.3 |
| 2004/0000528 | A1 | * | 1/2004 | Nagel | 211/59.3 |
| 2004/0065631 | A1 | * | 4/2004 | Nagel | 211/59.3 |

(Continued)

*Primary Examiner* — Joshua J Michener
*Assistant Examiner* — Devin Barnett
(74) *Attorney, Agent, or Firm* — Colin P. Cahoon; Shaukat A. Karjeker; Carstens & Cahoon, LLP

(57) ABSTRACT

An apparatus for storing and displaying packages. The invention discloses a self-adjusting shelf comprising a sled coupled to a track, and at least two product supports located in a plane above the track. The product supports are aligned substantially parallel to the track and are coupled to the track. Packages rest upon the product supports. The sled slides along the length of the track. The sled urges, via either gravity or a biasing device, the sled forward against downstream packages. Thus, when one package is removed, the sled forces the remaining packages to the front of the shelf.

23 Claims, 6 Drawing Sheets

(56) References Cited

U.S. PATENT DOCUMENTS

| | | | | |
|---|---|---|---|---|
| 2004/0173546 | A1* | 9/2004 | Nagel | 211/59.3 |
| 2004/0178156 | A1* | 9/2004 | Knorring et al. | 211/59.2 |
| 2006/0226095 | A1 | 10/2006 | Hardy | |
| 2006/0266726 | A1* | 11/2006 | Swanson | 211/186 |
| 2007/0108142 | A1 | 5/2007 | Medcalf | |
| 2007/0187344 | A1* | 8/2007 | Mueller et al. | 211/59.3 |
| 2007/0194037 | A1* | 8/2007 | Close | 221/100 |
| 2007/0251900 | A1 | 11/2007 | Hardy | |
| 2009/0184069 | A1 | 7/2009 | Hardy | |
| 2010/0108624 | A1* | 5/2010 | Sparkowski | 211/59.3 |
| 2010/0133219 | A1* | 6/2010 | Sun | 211/151 |
| 2010/0147783 | A1 | 6/2010 | Hardy | |
| 2010/0176075 | A1* | 7/2010 | Nagel et al. | 211/59.3 |
| 2010/0276383 | A1* | 11/2010 | Hardy | 211/59.3 |
| 2011/0017684 | A1* | 1/2011 | Nagel et al. | 211/59.3 |
| 2011/0049067 | A1* | 3/2011 | Garson et al. | 211/59.3 |
| 2011/0210086 | A1* | 9/2011 | Ciesick | 211/59.3 |
| 2011/0215060 | A1* | 9/2011 | Niederhuefner | 211/59.3 |

* cited by examiner

DUAL PLANE SELF-ADJUSTING SHELF

BACKGROUND OF THE INVENTION

1. Technical Field

The present invention relates to an apparatus for storing and displaying product.

2. Description of Related Art

Product is displayed in shelves. Often product on the back of the shelf is difficult for a consumer to view or retrieve. This is especially true for product located on a top shelf. Gravity-fed or pusher shelves urge packages forward to the front of the shelf. Unfortunately, these solutions fail to work properly for relatively light weight product. One such example is a package of snack food items, such as potato chips. These packages are often packaged in so called flex packages. Flex packages are very flexible, and as such, their corners and edges are free to bend which makes flex packages susceptible to snagging or twisting. Furthermore, due to their light weight, often gravity-fed shelving solutions fail to properly adjust the flex packaging forward. Accordingly, it is desirable to have a shelving solution which properly adjusts product to the front of the shelf. It is also desirable that such a shelving solution work with flex packaging.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicants' invention will now be described with reference to the drawings. Unless otherwise noted, like elements will be identified by identical numbers throughout all figures.

Figure 1:
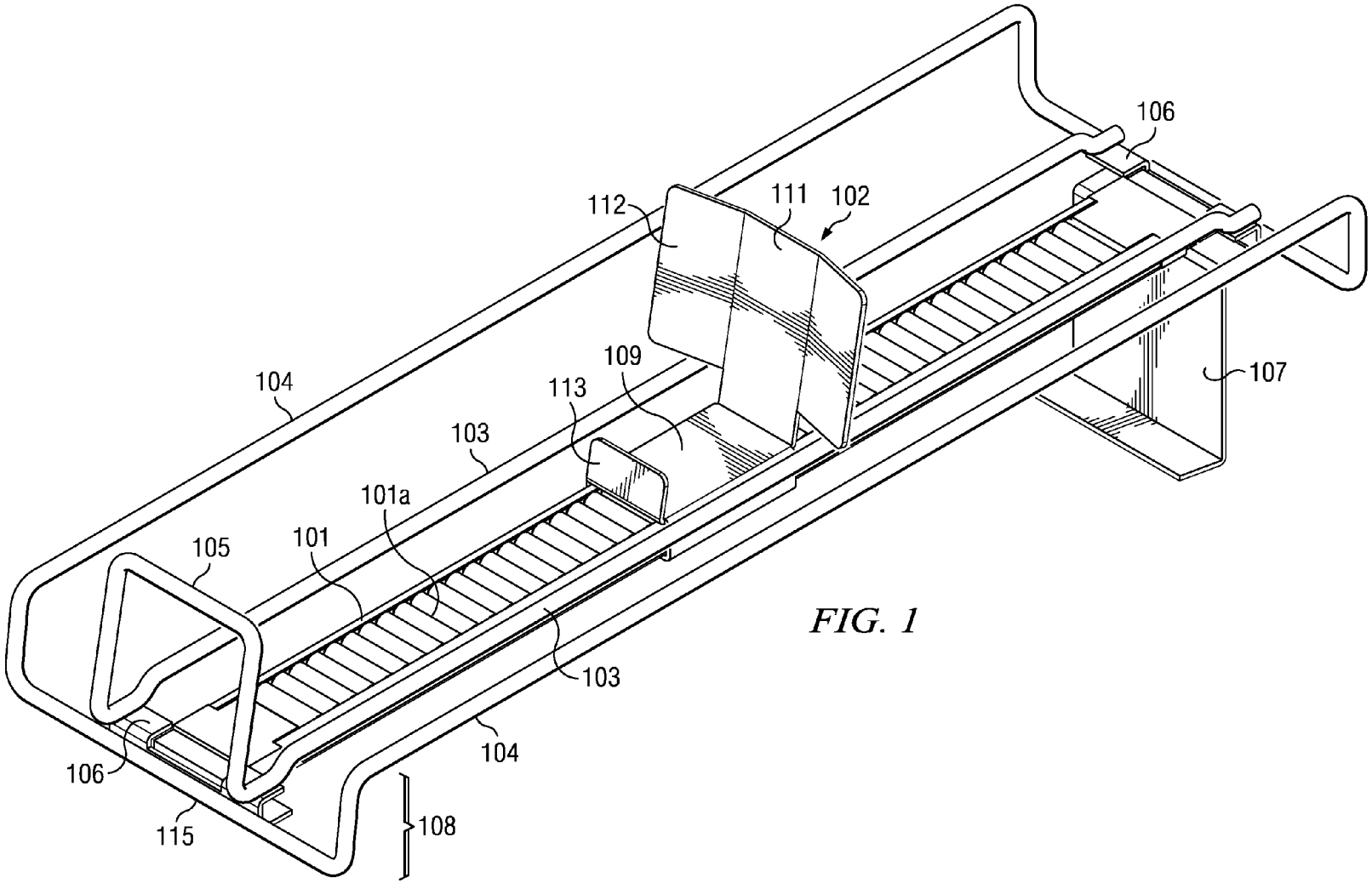
FIG. 1 is a perspective view of a shelf in one embodiment.

Generally, this invention relates to a self-adjusting shelf used to display product. FIG. 1 is a perspective view of the self-adjusting shelf in one embodiment. As used herein a "self-adjusting shelf" refers to any shelf which automatically urges the packages to the front of the shelf The self-adjusting shelf, just as other shelves, comprises a bottom, a front end, and a back end. In addition, the self-adjusting shelf comprises at least two product supports 103. As used herein "product support" refers to the region upon which product sits.

There are two types of self-adjusting shelves disclosed herein. The first is a gravity-fed self-adjusting shelf In this type of shelf, the shelf is inclined so that gravity acts upon the package and the sled 102 to urge the package forward. The second is a biased self-adjusting shelf This shelf utilizes a biasing device to urge the packages forward. This will be discussed in more detail below.

Referring back to FIG. 1, this figure illustrates a sled 102 coupled to a track 101, wherein the sled 102 slides upon the track 101. FIG. 1 also illustrates at least two product supports 103 located above the track 101, wherein the product supports 103 are coupled to and are substantially parallel to the track 101. A track is an elongated member which guides and controls the movement of the sled. As depicted, the track comprises an elongated roller track 101 which comprises rollers 101*a*. The roller track 101 can comprise any rollers upon which an object can be rolled. The rollers can comprise any rotating object which reduces friction. As an example, in one embodiment the rollers 101*a* comprise ball bearings. In one embodiment the roller track 101 comprises at least two or more rollers 101*a*. In one embodiment the rollers 101*a* lie in a direction perpendicular to the orientation of the roller track 101. It should be noted that while a roller track 101 is being illustrated, other tracks are possible. In one embodiment the track does not comprise rollers. In one embodiment the track does not comprise any moving parts. In one embodiment, the track is coupled with the sled so that the sled can slide along the track. In one embodiment the track comprises a material which reduces friction. In one embodiment the track comprises a silicon-impregnated material. In another embodiment the track comprises a high-slip powder coating which allows the sled to smoothly guide upon the track. While an embodiment is discussed utilizing a specific type of track, namely a roller track, it should be understood this is for illustrative purposes and should not be deemed limiting.

The roller track 101 is coupled to track support 106. As used herein "coupled" includes items that are both directly and indirectly connected. The track support 106 couples the roller track 101 to the rest of the shelf. In one embodiment the track support 106 is coupled to a stand 107. The stand 107 is any device which elevates the rear portion of the shelf so that the roller track 101 is inclined relative to the horizontal. The stand 107 can comprise an extended member as depicted, or the stand can comprise a structure to which the shelf is affixed and which holds the shelf in the inclined position. As an example, the shelf can be bolted or otherwise attached to an existing frame or wall to hold the shelf in the inclined position. The existing frame or wall is an example of a stand.

As depicted, the length of the stand 107 will depend on the desired angle of inclination 108. The required angle of inclination 108 will depend on a variety of factors including the weight of the product and the weight of the sled 102. In one embodiment the angle of inclination 108 ranges from about 5 degrees to about 45 degrees above the horizontal. In another embodiment the angle of inclination 108 ranges from about 5 degrees to about 26 degrees above the horizontal. In one embodiment wherein the product comprises flexible packages of 8 ounces, the angle of inclination is about 6 degrees. In one embodiment wherein the product comprises flexible packages of 2 ounces, the angle of inclination is about 8 degrees.

The stand 107 can be coupled to the track support 106 with any method known in the art. It can be welded or attached via screws, bolts, etc.

As depicted, the sled 102 comprises a back 111, wings 112, a lip 113, track guide 110, and product base 109. In one embodiment the back 111, wings 112, lip 113, track guide 110, and product base 109 are all integrally made so that the sled 102 comprises a single piece. In operation, at least one package is loaded so that it rests in a plane above the product base 109. The package also rests upon the back 111. The wings 112 offer additional support which keeps the package properly oriented. Likewise, the lip 113 keeps the package within the sled 102. In one embodiment the sled 102 does not comprise a lip 113.

In one embodiment the angle between the back 111 and the product base 109 is approximately equal to the angle of inclination 108. In one embodiment the back 111 and the wings 112 are substantially vertically oriented. In such embodiments the package will be presented in an upright and approximately vertical position.

The sled 102 further comprises the track guide 110. The track guide 110 maintains the sled in a proper orientation along the roller track 101. If the sled 102 is maintained in the proper orientation, then the package within the sled is likewise held in proper orientation. This ensures that any graphics on the packages are presented in their desired orientation.

As depicted the guide track 110 comprises a vertical and a horizontal member which engages the roller track 101. Those skilled in the art will understand there are other ways to couple the sled 102 with the roller track 101.

As discussed, the package rests above the base 109. As will be discussed in more detail below, in one embodiment the package does not rest upon the base 109 but instead rests upon product supports 103. The bottom portion of the base 109 sits upon the roller track 101. In one embodiment the bottom portion of the base 109 sits upon the rollers 101*a*. Thus, the weight of the sled 102 is concentrated on the rollers 101*a*. As such, the sled 102 can slidably move along the length of the roller track 101 along the rollers 101*a*. In one embodiment, left unimpeded, the sled 102 depicted in FIG. 1 will advance to the front of the shelf until stopped. In one embodiment the track support 106 prevents the sled 102 from advancing. In operation, as will be discussed below, the sled 102 is maintained in its position by one or more packages stacked in front of the sled 102.

Coupled to the track support 106 are the product supports 103. In another embodiment the product supports 103 are directly coupled to the roller track 101. In one embodiment there are two or more product supports 103. The packages rest upon the product supports 103. In one embodiment the product supports 103 lay in a horizontal plane located above the roller track 101. In one embodiment the product supports 103 comprise two parallel wires or rods. In one embodiment the product supports 103 run the length of the roller track 101. In another embodiment each product support 103 comprises a solid piece of material as opposed to an elongated member or rod. In one embodiment the solid product supports 103 are separated by a gap located above the roller track. Because the product supports 103 are separated by a gap which extends for the length of the track, the product supports 103 are considered to be two product supports 103. Thus, in one embodiment the raised plane upon which the product sits comprises a gap, and the track 101 is recessed within the gap. In one embodiment the sled 102 rides on the track 101 but does not rest or slide upon the product supports 103. Thus, the sled 102 obtains the benefits of the track, specifically the guiding properties and if applicable friction reducing properties, but the sled 102 does not touch the product supports 103. Thus, the friction reducing properties, if any, of the product support 103 are not reduced or otherwise injured by the sled 102. In one embodiment the sled 102 rests completely on the track 102, wherein the track 102 is located below the product supports 103 which support the product. In one embodiment the sled is supported by a track 101 located in a lower plane whereas the package 114 is supported by product supports 103 located in an upper plane.

Figure 2:
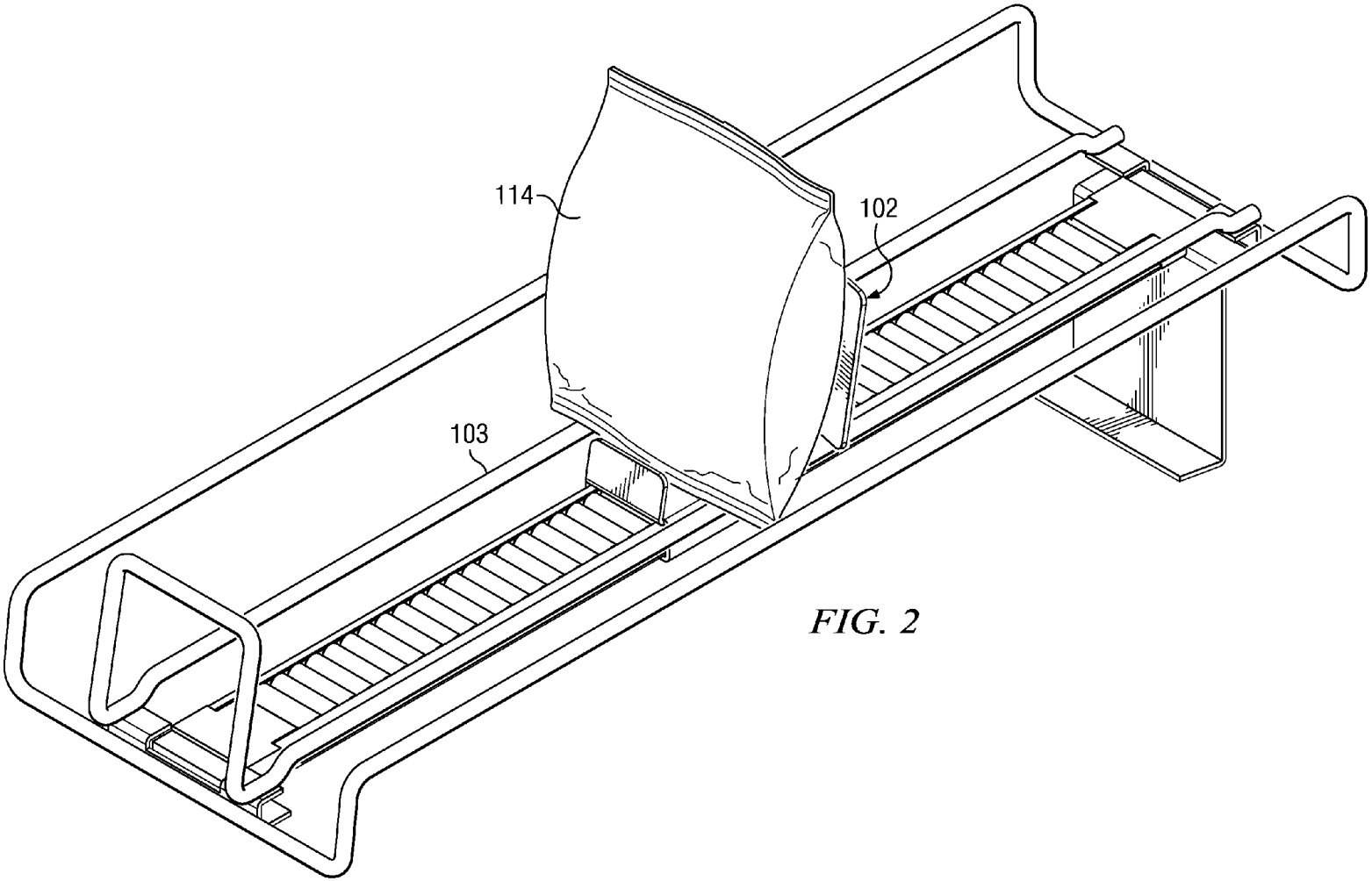
FIG. 2 illustrates a perspective view of the sled loaded with product in one embodiment.

FIG. 2 illustrates a perspective view of the sled loaded with product in one embodiment. As depicted the package 114 rests upon the product support 103. In one embodiment only a single package 114 is loaded within the sled 102 and the remainder of the downstream packages are not within the confines of the sled 102. In other embodiments, however, two or more packages 114 are loaded within the sled 102. A package within the confines of the sled 102 is referred to as the loaded package. A package is within the confines of the sled 102 if the package rests above the base 109.

The package 114 can comprise virtually any package 114 of virtually any size. For example the package 114 can include flexible packaging, boxes, cans, bottles, snack chips, bound paper-based products such as books and magazines, plastic encased product such as DVD's, etc. As depicted the package 114 comprises a flex package. The packages 114 can vary in weight and can range from less than an ounce to more than a pound. As will be discussed in more detail below, the weight of the sled 102 can be adjusted to help urge packages to the front of the shelf.

The product supports 103 are separated by a distance at least as great as the width of the roller track 101. In one embodiment the product support 103 is separated by a distance of between about ¼ of an inch to about 12 inches. In another embodiment the product support 103 is separated by a distance of between about 1 and about 8 inches. The product support 103 distance is dependent upon the packaging type and size.

The product supports 103 form a plane which is above the roller track 101. The product supports 103 can be from about ¼ of an inch to 5 inches above the roller track 101. This distance will be dependent upon the size and geometry of the package 114.

As depicted, the package 114 rests upon and slides along the product supports 103. In one embodiment the product supports 103 comprise a friction reducing coating. In one embodiment the product supports 103 comprise a powder coated finish.

In operation the sled 102 is urged forward by either gravity or a biasing device. The sled 102 slides along the roller track 101 and applies force to the loaded package 114 causing it to glide forward along the product support 103. If the loaded package 114 is in contact with other downstream packages, then this force is also imparted to downstream packages. Upstream and downstream refers to relative locations along the shelf. An upstream package is a package closer to the back of the shelf whereas a downstream package refers to a package which is closer to the front of the shelf.

Figure 3:
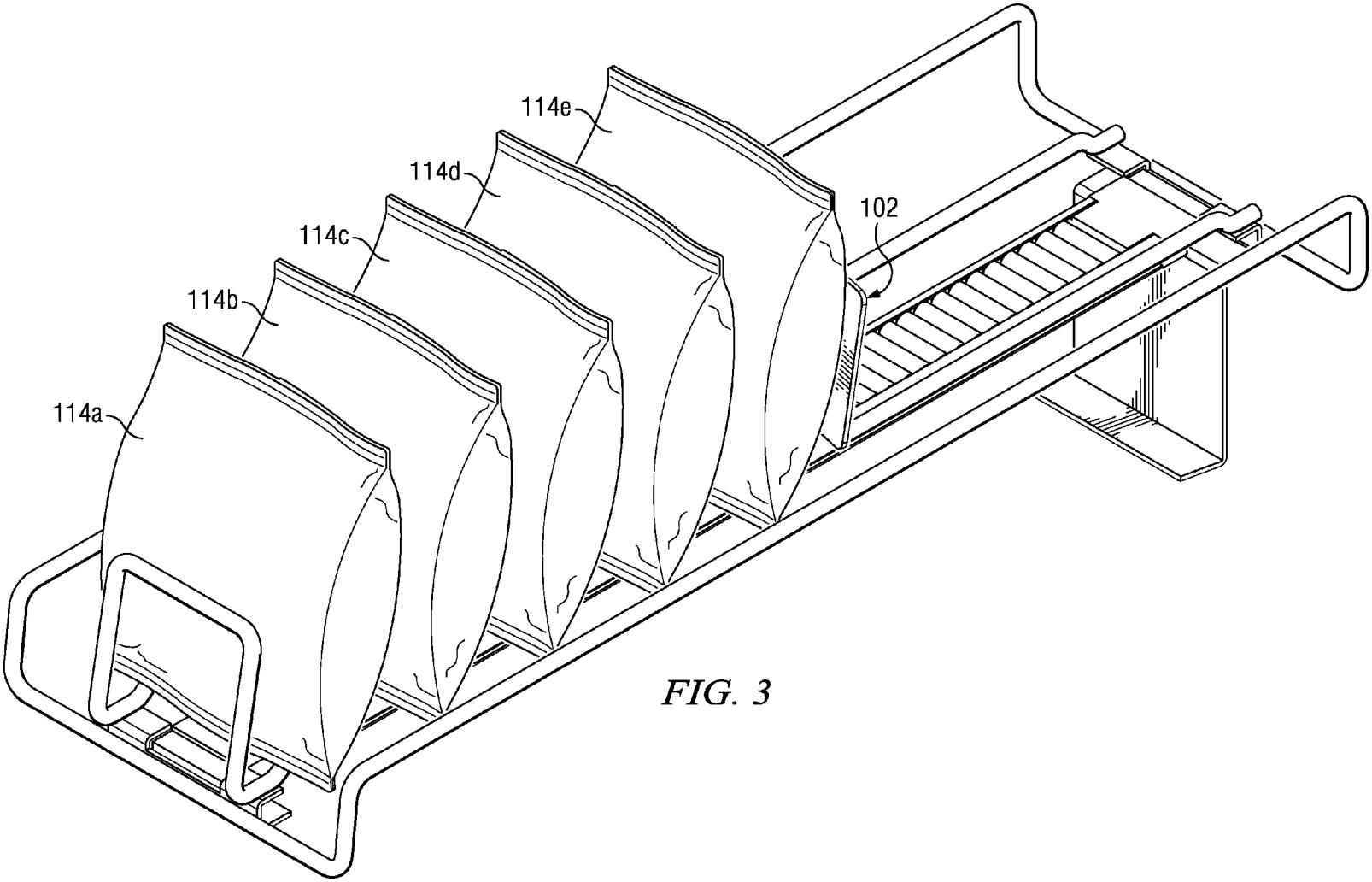
FIG. 3 is a perspective view of a shelf in one embodiment comprising a plurality of packages.

FIG. 3 illustrates a perspective view of the shelf with a plurality of packages in one embodiment. As illustrated the shelf is loaded with five packages 114. When the package 114*a* located at the front of the shelf is removed, the upstream packages 114*b-e* adjust to fill the void. In operation, once a downstream package is removed, there is an absence of force to counteract the urging of the sled 102. Accordingly, the force of the sled 102 urges the remaining packages 114 forward.

The packages 114*a-e* are held in position by the shelf lip 105. The shelf lip 105 counteracts the force of the sled 102. The shelf lip 105 is coupled to the shelf. In one embodiment the shelf lip 105 is coupled to the track support 106. In another embodiment the shelf front 105 is coupled to the product supports 103. The shelf lip 105 can comprise plastic, wire, metal, etc. In one embodiment the shelf lip 105 comprises a U-shaped member which connects the product supports 103. The height of the shelf lip 103 can vary in relation to the height of the package. In one embodiment the shelf lip 103 acts as a simple "stop" which raises to about half the height of the package. In another embodiment the shelf lip 103 extends to just under the height of the package whereas in other embodiments the shelf lip 103 extends above the package. In one embodiment the shelf lip 103 comprises a planar surface. As an example, in one embodiment the shelf lip 103 comprises a sheet of transparent plastic.

Referring back to FIG. 1, this figure illustrates side rails 104. As depicted, the side rails 104 run parallel to the roller track 101. The optional side rails 104 help keep the packages within the shelf and help keep the packages properly aligned. The shelf can comprise one or more side rails 104. In embodiments wherein two shelves are placed adjacent to one another, a single side rail 104 can act as a side rail for two shelves. The side rails 104 can be located at virtually any location along the height of the package 114. In one embodiment the side rails 104 are located above the product supports 103. In one embodiment the distance separating the side rails 104 is greater than the distance separating product supports 103. The side rails 104 can be coupled to the shelf in a variety of means. In one embodiment the side rails 104 are coupled to the track support 106. In another embodiment the side rails 104 are coupled to a cross member 115 which couples the side rails 104 to the track support 106. The side rails 104 can comprise wires, rods, plastic, or metal.

As illustrated in FIG. 1 the wings 112 of the sled 102 are located above the track support 103 and extend within the side rails 104. Thus, the wings 112 and the side rails 104 act to maintain proper orientation of the package 114. Further, as depicted, the side rails 104 and the product supports 103 ensure proper orientation of the sled 102. As can be seen, the side rails 104 and the product supports 103 prevent the sled 102 from tipping too far in one direction, thus maintaining the sled 102 in the desired alignment. As discussed above, if the sled 102 becomes misaligned, then the packages likewise become misaligned. In one embodiment it is desirable to keep the packages properly aligned so that their graphics may be properly viewable. As depicted the width of the back 111 and wings 112 of the sled 102 is greater than the distance between the product supports 103 but is less than the distance between the two side rails 104.

Referring back to FIG. 2, one benefit of the instant invention can be illustrated. Because the package 114 slides along the product support 103, the product is elevated in a higher plane relative to the roller track 101. If the package were placed directly on the roller track 101 then the edges and corners of the package 114 can become entangled in the rollers 101 which undesirably prevents the package 114 from urging forward. By storing the product above the roller track 101, the possibility that the package 114 can be stuck, snagged, or otherwise stopped along the rollers 101*a* is eliminated while the benefits of the rollers are still realized. Specifically, the roller track 101 reduces friction as the sled slides down the roller track 101. This means that less force is required to move the sled 102 down the roller track 101. Taken further, this means that less force is required to move and adjust downstream packages. As such, the friction reducing benefits of the rollers are maintained, while the possibility that the package 114 will become stuck within the rollers 101*a* is reduced. A similar advantage is realized in the embodiments wherein a track without rollers is utilized. In such an embodiment friction is reduced due to the materials of manufacture or coating, and yet packages are prevented from being caught or entangled between the sled 102 and the track 101.

There are many advantages for having a fixed roller track 101 and a sled 102 which rolls along the roller track 101. One example is that the sled 102 does not have to comprise moving parts. Thus, the sled 102 is less expensive to manufacture than a sled 102 having moving parts. Second, by having a plurality of rollers 101*a*, if one roller 101*a* locks up or otherwise becomes damaged, often the momentum of the moving package and the other rollers 101*a* will carry the package forward to the front of the shelf. However, if only a single roller was utilized, either on the track 101 or on the sled 102, and the roller locks up or otherwise becomes damaged, the package will not self-adjust. Furthermore, if a single roller was located on the sled 102 and the path for that roller became obstructed, by for example, a buildup of dirt or dust, the movement of the sled 102 can be halted. Additionally, due to the presence of a plurality of rollers 101*a*, the weight of the sled 102 is distributed along multiple rollers. Further, in the event that lubrication of the rollers is necessary, it is possible to lubricate the rollers without having to remove the sled 102 prior to lubrication. If rollers are located on the sled 102, then the sled 102 would likely need to be removed prior to lubrication.

While having rollers located on the track 101 offers many advantages, in one embodiment the rollers are located on the sled 102. In such an embodiment the sled 102 engages the track 101 as previously discussed, but rather than having the rollers attached to the track 101, the rollers are attached to the sled 102. In one embodiment two or more rollers are attached to the sled 102. The rollers would engage and roll upon the track 101.

Figure 4:
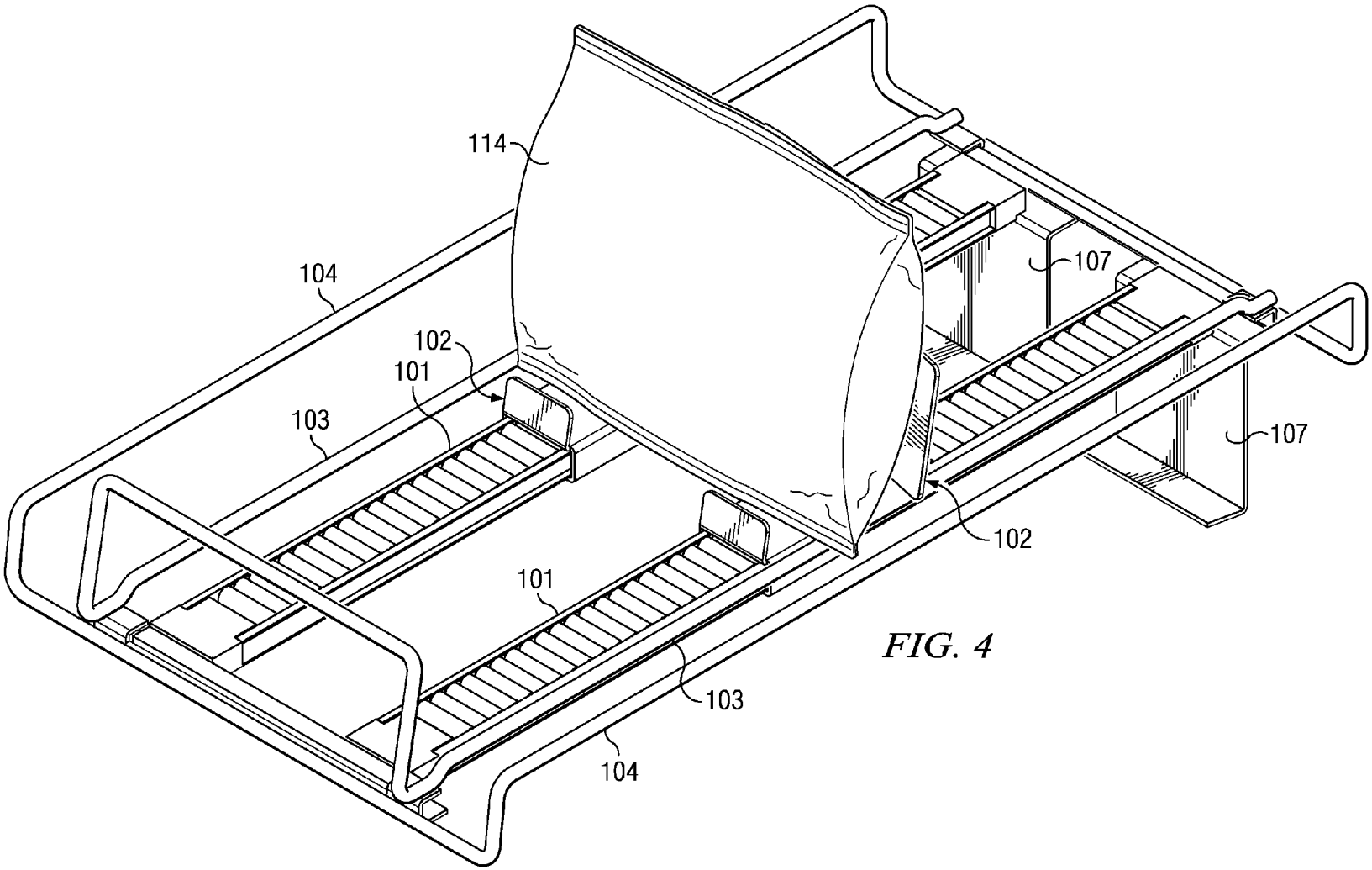
FIG. 4 illustrates a perspective view of one shelf utilizing two roller tracks in one embodiment.

FIG. 4 illustrates a perspective view of one shelf utilizing two roller tracks in one embodiment. As illustrated, the shelf comprises two roller tracks 101 and two sleds 102. This embodiment allows for a wider package 114. As illustrated the package 114 rests upon product supports 103, wherein the product supports 103 comprise two parallel members. However, the product supports 103 may comprise additional members. For example, while not illustrated this embodiment may additionally comprise a product support 103 located between the two roller tracks 101. This embodiment provides for a wider package but which does not require a wider sled 102. Instead, multiple sleds 102 urge the package 114 forward as previously discussed.

As stated above, one type of self-adjusting shelf is a gravity-fed shelf. In such an embodiment, the weight of the sled 102 offers additional force to urge the product forward. In embodiments not comprising a weighted sled 102, often the weight of the packages were insufficient to urge downstream packages forward to the front of the shelf. However, by using a weighted sled 102 in conjunction with a friction reducing device such as a roller track 101, the weight of the sled 102 provides additional force to urge the package. As those skilled in the art will understand, the necessary weight of the sled 102 is dependent upon the weight of the packages as well as the angle of inclination 108. As the angle of inclination 108 is increased, the necessary sled weight is decreased.

Figure 5:
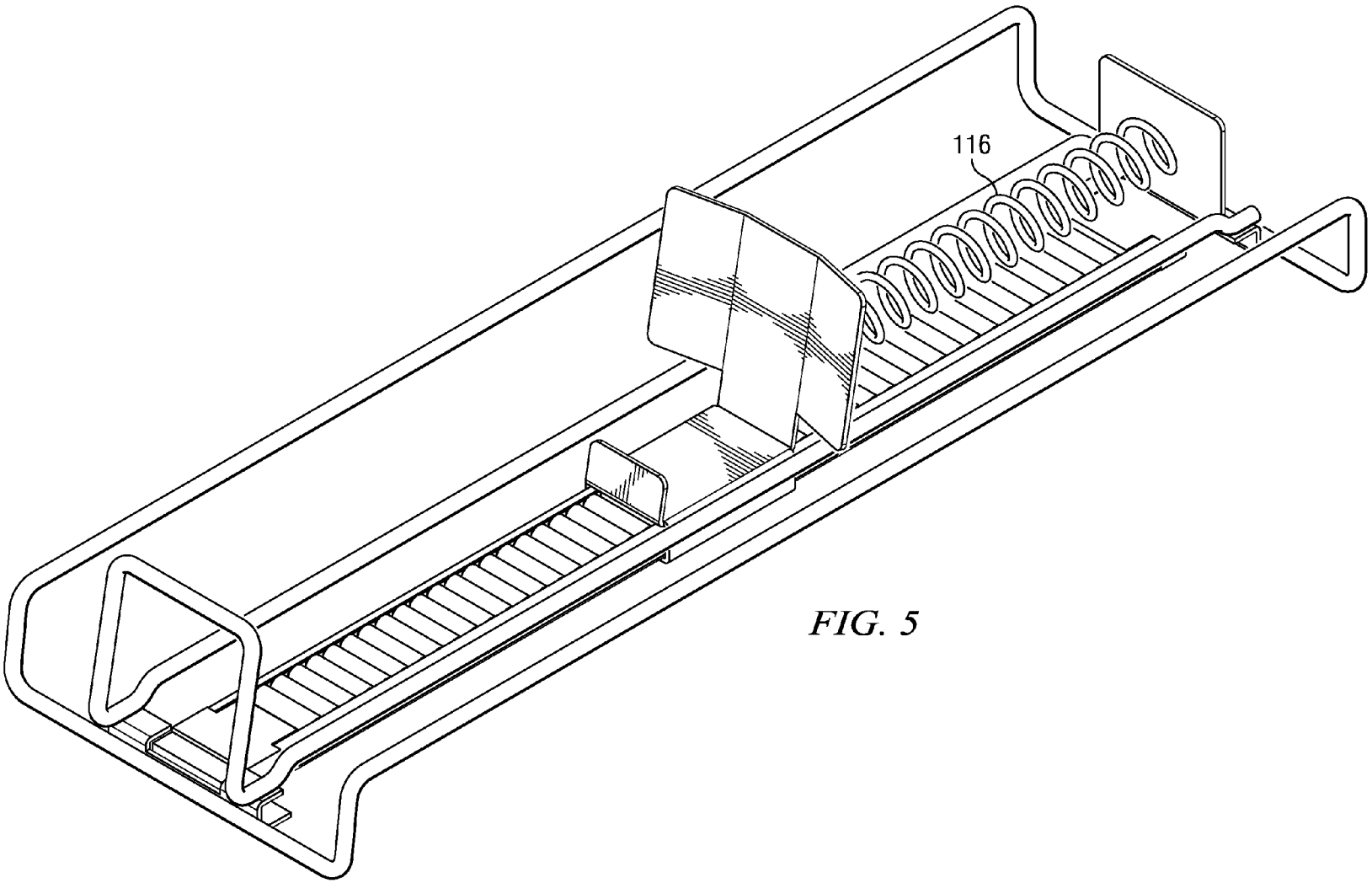
FIG. 5 is a perspective view of a shelf using a biasing device 116 in one embodiment.

FIG. 5 is a perspective view of a shelf using a biasing device 116 in one embodiment. A biasing device is any device which applies force to urge the sled 102. A biasing device 116 may comprise springs, coils, etc. The biasing device 116 may be located upstream or downstream from the sled 102. Thus, the biasing device 116 may exert a pushing or pulling force upon the sled 102. Those skilled the art will understand that the strength of the biasing device 116 can be adjusted depending upon the size, weight, and number of the packages being adjusted.

In one embodiment two or more self-adjusting shelves are placed adjacent to or above one another. For example, in one embodiment nine self-adjusting shelves are utilized to form a rack of three rows, each row comprising three shelves. In one embodiment wherein two self-adjusting shelves are adjacently placed, common structure and/or members are shared.

For example, as discussed above, two adjacent shelves may share a common side rail 104. Likewise, a single product support 106 can extend to couple two tracks 101 on adjacent shelves. In another embodiment the cross member 115 couples two adjacent shelves. In another embodiment adjacent shelves are coupled together by wires, bolts, and other devices known in the art. In one embodiment a single stand 107 is utilized for two or more adjacent shelves.

Figure 6:
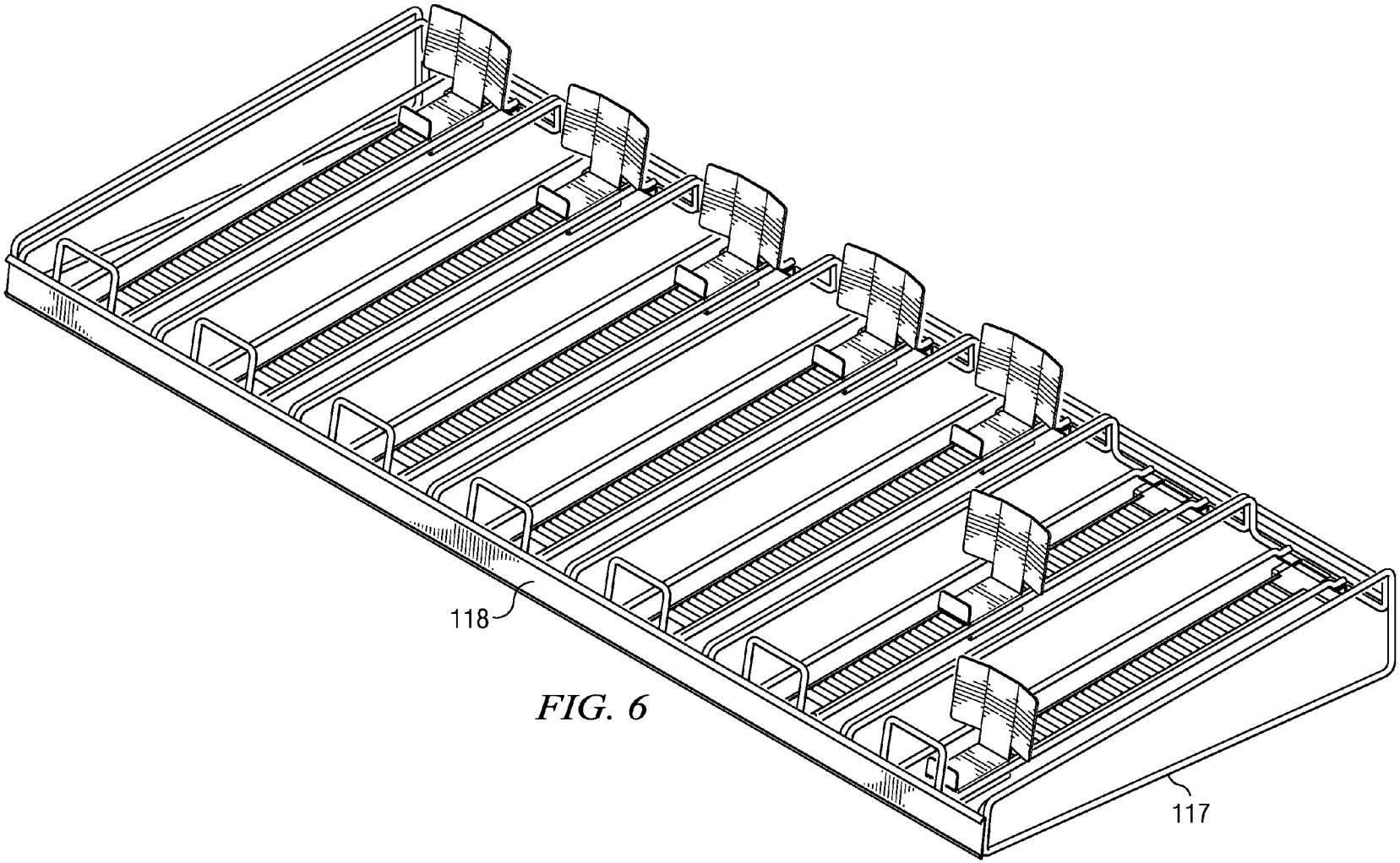
FIG. 6 is a perspective view of a plurality of shelves adjacently placed.

FIG. 6 is a perspective view of a plurality of shelves adjacently placed. As depicted the shelves are connected via a shelf structure 117. The shelf structure 117 couples the self-adjusting shelves. In one embodiment the shelf structure 117 supports the shelves. In one embodiment the shelf structure 117 comprises any structure necessary to support and/or couple the shelves. As depicted the shelf structure 117 comprises side support structures on both sides of the adjacent shelves. The side support structures can be the same height as the side rails 104, or they can be higher or lower than the side rails 104. As depicted the shelf structure 117 surrounds the periphery of the self-adjusting shelves. In other embodiments the shelf structure 117 comprises a cross member coupled to each of the side structures and which is coupled to and offers support to one or more roller tracks 101. As depicted the shelf structure 117 further comprises a display tag 118. Information and data can be placed upon the display tag 118. For example, the display tag 118 may comprise bar codes, price tags, etc.

The self-adjusting shelf discussed herein can be utilized in a variety of places. As discussed, a rack may comprise one or more self-adjusting shelves. These shelves may comprise the same size or different sizes. In another embodiment, the self-adjusting shelf is used as a topper. A topper as used herein refers to a shelf which is placed upon an existing structure. The existing structure can comprise another shelf, a cabinet, a check-out counter, a refrigerator, or other such structures. As an example, the self-adjusting shelf can be placed atop a mini-refrigerator which is common at many commercial check-out counters. The self-adjusting shelf urges packages forward to the front of the shelf so that a consumer can easily obtain the desired package. In one embodiment the self-adjusting shelf is placed as a topper atop a structure which has sufficient upper clearance space that can accommodate the added shelf In one embodiment comprising two or more vertical rows of self-adjusting shelves, each row has the same angle of inclination. In one embodiment each shelf is coupled to a stand such as a wall or existing structure to achieve the angle of inclination. Such an embodiment offers an efficient use of available space.

The self-adjusting shelf can be supported from below by existing structure or the ground as discussed above. In another embodiment the self-adjusting shelf is supported by affixing the shelf to a wall or existing structure. The existing structure can comprise rods, wire, a shelf, etc. In such an embodiment the shelf operates as a suspended hanger. For example, the rear portion of the shelf is mounted to a wall or existing structure and the front portion of the shelf is suspended above the ground. In such an embodiment the side rails 104 can be affixed to a wall or existing structure. In another embodiment the shelf is affixed via the product supports 103, the track 101, the track support 106, or via any other known mounting device.

While the invention has been particularly shown and described with reference to a preferred embodiment, it will be understood by those skilled in the art that various changes in form and detail may be made therein without departing from the spirit and scope of the invention.

Additional Description

The following clauses are offered as further description of the disclosed invention.

1. A self-adjusting shelf comprising:
   a track;
   a sled, wherein said sled is coupled to said track, and wherein said sled slides upon said track;
   at least two product supports located above said track, wherein said product supports are aligned substantially parallel to said track, and wherein said product supports are coupled to said track.
2. The self-adjusting shelf according to any preceding clause wherein said track is inclined relative to a horizontal plane.
3. The self-adjusting shelf according to clause 2 wherein said track is inclined at an angle of about 5 degrees to about 8 degrees.
4. The self-adjusting shelf according to clause 2 wherein said sled comprises a substantially vertical back and two substantially vertical wings coupled to said back.
5. The self-adjusting shelf according to clause 4 wherein said sled further comprises a base, wherein said base sits upon said track.
6. The self-adjusting shelf according to any preceding clause further comprising a stand coupled to a rear end of said roller track.
7. The self-adjusting shelf according to any preceding clause wherein said at least two product supports comprise at least two parallel rods.
8. The self-adjusting shelf according to any preceding clause wherein said product supports are coupled to a track support which is coupled to said track.
9. The self-adjusting shelf according to any preceding clause further comprising a shelf lip.
10. The self-adjusting shelf according to clause 9 wherein said shelf lip comprises a U-shaped member that connects the at least two product supports.
11. The self-adjusting shelf according to any preceding clause further comprising at least one side rail, wherein said side rail is coupled to said track, and wherein said at least one side rail is oriented parallel to said track.
12. The self-adjusting shelf according to any preceding clause further comprising at least two side rails, wherein said at least two side rails are coupled to said track, and wherein said at least two side rails are oriented parallel to said track.
13. The self-adjusting shelf according to clause 12 wherein said sled comprises a back and two wings coupled to said back.
14. The self-adjusting shelf according to clause 13 wherein said product supports are separated by a distance, wherein said at least two side rails are separated by a distance, and wherein said the width of said back and said wings of said sled is greater than the distance between said product supports but is less than the distance between said at least two side rails.
15. The self-adjusting shelf according to any preceding clause further comprising a biasing device coupled to said sled.
16. The self-adjusting shelf according to clause 15 wherein said biasing device comprises a spring.
17. The self-adjusting shelf according to any preceding clause wherein said track comprises a plurality of rollers.
18. The self-adjusting shelf according to any preceding clause wherein said product supports comprise a powder coated finish.
19. The self-adjusting shelf according to any preceding clause wherein said product supports are located about ¼ of an inch to about 5 inches above the track.

20. The self-adjusting shelf according to any preceding clause comprising at least one package loaded in said sled.

21. The self-adjusting shelf according to any preceding clause wherein said sled comprises a plurality of rollers.

We claim:

1. A self-adjusting shelf comprising:

an inclined roller track having a plurality of rollers configured for low friction sliding of a sled thereon;

a sled coupled to said roller track, the sled having a forward-extending base and the sled having a mass to permit sliding along the rollers, the sled having a back extending upwardly from the base and wings on each side of the back, the back having a width greater than a width of the base; and at least two product supports with upper surfaces, each of the at least two product supports substantially aligned with the roller track on opposing sides of the roller track, and located above the roller track, the at least two product supports are elevated above the base of the sled and are configured to support product packages on the upper surfaces above the roller track when the self-adjusting shelf is in use displaying product packages thereon;

whereby, when in use displaying product packages, an angle of inclination of the inclined roller track operatively cooperates with the rollers, the mass of the sled, and the upper surfaces of the product supports to enable the sled to move forward under gravitational force to urge packaged products to a front of the shelf when a packaged product in front of the sled is removed from the shelf.

2. The self-adjusting shelf of claim 1 wherein said roller track is inclined at an angle of 5 degrees to 8 degrees.

3. The self-adjusting shelf of claim 1 wherein said back and said wings of said sled are substantially vertical, and wherein the width of the back with the wings is greater than a distance between the at least two product supports.

4. The self-adjusting shelf of claim 1 further comprising a stand coupled to a rear end of said roller track.

5. The self-adjusting shelf of claim 1 wherein said at least two product supports comprise at least two parallel rods.

6. The self-adjusting shelf of claim 1 wherein at least two said product supports are coupled to a track support which is coupled to said roller track.

7. The self-adjusting shelf of claim 1 further comprising a shelf lip.

8. The self-adjusting shelf of claim 7 wherein said shelf lip comprises a U-shaped member that extends between and connects a corresponding pair of the at least two product supports.

9. The self-adjusting shelf of claim 1 further comprising at least one side rail, wherein said at least one side rail is oriented parallel to said roller track.

10. The self-adjusting shelf of claim 1 further comprising at least two side rails, wherein said at least two side rails are each oriented parallel to said roller track.

11. The self-adjusting shelf of claim 10 wherein a corresponding pair of said at least two product supports are separated by a first distance, wherein said at least two side rails are separated by a second distance, wherein the width of said back with the wings of said sled is greater than the first distance between said corresponding pair of product supports but is less than the second distance between said at least two side rails.

12. The self-adjusting shelf of claim 1 further comprising a biasing device coupled to said sled.

13. The self-adjusting shelf of claim 12 wherein said biasing device comprises a spring.

14. The self-adjusting shelf of claim 1 wherein said at least two product supports each comprise a powder coated finish.

15. The self-adjusting shelf of claim 1 wherein said at least two product supports are each located ¼ of an inch to about 5 inches above the roller track.

16. The self-adjusting shelf of claim 1 wherein said base of the sled is integral with said back.

17. The self-adjusting shelf of claim 1 wherein said base of the sled is directly coupled to said back.

18. The self-adjusting shelf of claim 1 wherein said base of the sled intersects said back.

19. The self-adjusting shelf of claim 1 wherein said base of the sled extends in a plane at a right angle to a plane of the base.

20. The self-adjusting shelf of claim 1 wherein said base of the sled makes contact with said roller track.

21. The self-adjusting shelf of claim 1 wherein said roller track is inclined at an angle of about 5 degrees to about 45 degrees.

22. A self-adjusting shelf comprising:

an inclined roller track having a plurality of rollers configured for low friction sliding of a sled thereon;

a sled coupled to the roller track, the sled having a forward-extending base, the sled having a mass to permit sliding along the rollers, the sled having a back extending upwardly from the base of the sled and wings on each side of the back, the back with the wings having a width greater than a width of the base of the sled; and a pair of product supports, each one of the pair of product supports having an upper surface extending along opposing sides of the base of the sled, the product supports are located above the roller track and the base of the sled, the product supports support product packages on the upper surfaces when the self-adjusting shelf is in use displaying product packages;

whereby, when in use, an angle of inclination of the inclined roller track operatively cooperates with the rollers of the track, the mass of the sled, and the upper surfaces of the product supports to enable the sled to move forward under gravitational force to urge packaged products to a front of the shelf when a packaged product in front of the sled is removed from the shelf.

23. The shelf of claim 22, wherein an underside of the base comprises rollers.

* * * * *